US010903550B2

(12) United States Patent
Bryce

(10) Patent No.: US 10,903,550 B2
(45) Date of Patent: Jan. 26, 2021

(54) BASE STATION ANTENNAS INCLUDING SUPPLEMENTAL ARRAYS

(71) Applicant: CommScope Technologies LLC, Hickory, NC (US)

(72) Inventor: Colin C. Bryce, Coventry (GB)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/282,465

(22) Filed: Feb. 22, 2019

(65) Prior Publication Data

US 2019/0190127 A1 Jun. 20, 2019

Related U.S. Application Data

(63) Continuation of application No. 16/089,701, filed as application No. PCT/US2018/014364 on Jan. 19, 2018, now Pat. No. 10,270,159.

(Continued)

(51) Int. Cl.
*H01Q 1/42* (2006.01)
*H01Q 21/28* (2006.01)

(Continued)

(52) U.S. Cl.
CPC ..... *H01Q 1/246* (2013.01); *H01Q 1/22* (2013.01); *H01Q 1/42* (2013.01); *H01Q 9/32* (2013.01);

(Continued)

(58) Field of Classification Search
CPC ..... H01Q 1/246; H01Q 1/42; H01Q 21/26; H01Q 21/28; H01Q 19/108; H01Q 9/32; H01Q 1/22; H01Q 21/08; H01Q 25/001
See application file for complete search history.

(56) References Cited

U.S. PATENT DOCUMENTS 7,043,280 B1 5/2006 Shields et al.
8,228,256 B2 * 7/2012 Puente Baliarda .... H01Q 1/246 343/844

(Continued)

FOREIGN PATENT DOCUMENTS

EP 2521219 4/2013
WO 2015/031072 3/2015

OTHER PUBLICATIONS

Extended European Search Report corresponding to European Patent Application No. 18744882.4, dated Nov. 29, 2019, 9 pages.

*Primary Examiner* — Hoang V Nguyen
(74) *Attorney, Agent, or Firm* — Myers Bigel, P.A.

(57) ABSTRACT

Multi-band base station antenna units include a first base station antenna that has a first housing, a first radome extending forwardly from the first housing, a first vertically-disposed linear array of low-band radiating elements mounted behind the first radome and a second vertically-disposed linear array of mid-band radiating elements mounted behind the first radome. These base station antenna units also include a second base station antenna that has a second housing, a second radome extending forwardly from the second housing and a third array of high-band radiating elements mounted behind the second radome. The first and second base station antennas are mounted in a vertically stacked arrangement and are configured to be mounted as a single structure.

20 Claims, 9 Drawing Sheets

Related U.S. Application Data

(60) Provisional application No. 62/449,655, filed on Jan. 24, 2017.

(51) Int. Cl.

| | |
|---|---|
| ***H01Q 1/24*** | (2006.01) |
| ***H01Q 9/32*** | (2006.01) |
| ***H01Q 21/26*** | (2006.01) |
| ***H01Q 21/08*** | (2006.01) |
| ***H01Q 1/22*** | (2006.01) |
| ***H01Q 25/00*** | (2006.01) |
| *H01Q 19/10* | (2006.01) |

(52) U.S. Cl.
CPC ..... *H01Q 21/08* (2013.01); *H01Q 21/26* (2013.01); *H01Q 21/28* (2013.01); *H01Q 25/001* (2013.01); *H01Q 19/108* (2013.01)

(56) References Cited

U.S. PATENT DOCUMENTS

| | | | | |
|---|---|---|---|---|
| 8,497,814 | B2 * | 7/2013 | Puente | H01Q 1/246 343/893 |
| 2004/0174317 | A1 | 9/2004 | Dearnley et al. | |
| 2005/0012665 | A1 * | 1/2005 | Runyon | H01Q 1/246 342/372 |
| 2006/0244675 | A1 | 11/2006 | Elliot et al. | |
| 2009/0224995 | A1 | 9/2009 | Puente et al. | |
| 2012/0128040 | A1 * | 5/2012 | Kenington | H01Q 1/1242 375/219 |
| 2012/0280878 | A1 * | 11/2012 | Timofeev | H01Q 5/42 343/793 |
| 2013/0038506 | A1 | 2/2013 | Johansson et al. | |
| 2014/0118196 | A1 | 5/2014 | Koskiniemi | |
| 2014/0242930 | A1 | 8/2014 | Barker et al. | |
| 2015/0042513 | A1 | 2/2015 | Foo | |
| 2015/0222013 | A1 * | 8/2015 | Choi | H01Q 1/246 343/879 |
| 2015/0288065 | A1 * | 10/2015 | Liu | H01Q 1/246 343/835 |
| 2016/0308286 | A1 | 10/2016 | Schmutzler et al. | |
| 2016/0329630 | A1 | 11/2016 | Mustajarvi et al. | |

* cited by examiner

BASE STATION ANTENNAS INCLUDING SUPPLEMENTAL ARRAYS

CROSS-REFERENCE TO RELATED APPLICATIONS

The present application is a continuation under 35 U.S.C. § 120 of U.S. patent application Ser. No. 16/089,701, filed Sep. 28, 2018, which in turn is a 35 U.S.C. § 371 national stage application of PCT Application No. PCT/US2018/014364, filed on Jan. 19, 2018, which itself claims priority from and the benefit of U.S. Provisional Patent Application Ser. No. 62/449,655, filed Jan. 24, 2017, the entire contents of each of which is incorporated herein by reference as if set forth in their entireties. The above-referenced PCT Application was published in the English language as International Publication No. WO 2018/140305 A1 on Aug. 2, 2018.

FIELD

The present invention generally relates to radio communications and, more particularly, to base station antennas that support communications in multiple frequency bands.

BACKGROUND

Cellular communications systems are well known in the art. In a typical cellular communications system, a geographic area is divided into a series of regions that are referred to as "cells," and each cell is served by one or more base stations. A base station may include baseband equipment, radios and antennas that are configured to provide two-way radio frequency ("RF") communications with mobile subscribers that are geographically positioned within the cell. A common cellular communications system network plan involves a base station serving a cell using three base station antennas, wherein each base station antenna serves a 120 degree "sector" of the cell in the azimuth plane. The base station antennas are often mounted on a tower or other raised structure, with the radiation pattern ("antenna beam") that is generated by each base station antenna directed outwardly to serve the respective sector. Typically, a base station antenna is implemented as a phase-controlled array of radiating elements, with the radiating elements arranged in one or more vertical columns. Herein, "vertical" refers to a direction that is perpendicular relative to the plane defined by the horizon.

As demand has grown for cellular communications systems to support increased capacity and provide enhanced capabilities, a variety of new cellular services have been introduced. These new services typically operate in different frequency bands from existing services to avoid interference. When new services are introduced, the existing "legacy" services typically must be maintained to support legacy mobile devices. Thus, as new services are introduced, either new cellular base stations must be deployed or existing cellular base stations must be upgraded to support the new services in the new frequency bands. In order to reduce cost and the total number of base station antennas deployed, base station antennas are now available that include at least two different arrays of radiating elements, where each array of radiating elements supports a different type of cellular service in a different frequency band. Such antennas are typically referred to as multi-band antennas.

SUMMARY

Pursuant to embodiments of the present invention, base station antenna units are provided that include a first base station antenna that has (1) a first housing, a first radome having a front surface that is positioned in front of the first housing, a first vertically-disposed linear array of low-band radiating elements mounted behind the front surface of the first radome and a second vertically-disposed linear array of mid-band radiating elements mounted behind the front surface of the first radome and (2) a second base station antenna that has a second housing that is separate from the first housing, a second radome having a front surface that is positioned in front of the second housing and a third array of high-band radiating elements mounted behind the front surface of the second radome, the second radome being separate from the first radome. The first and second base station antennas are mounted in a vertically stacked arrangement and are configured to be mounted as a single structure.

In some embodiments, a periphery of a first horizontal cross-section through a central portion of the first base station antenna may be substantially the same as a periphery of a second horizontal cross-section through a central portion of the second base station antenna.

In some embodiments, the third array of high-band radiating elements may be a planar array of radiating elements. This planar array may include at least four vertical columns of high-band radiating elements.

In some embodiments, a horizontal width of the first radome may be substantially the same as a horizontal width of the second radome.

In some embodiments, the second base station antenna is stacked above the first base station antenna.

In some embodiments, a height along the vertical direction of the second base station antenna may be less than 0.6 meters.

In some embodiments, a maximum horizontal depth of the first base station antenna may be less than a maximum horizontal depth of the second base station antenna.

In some embodiments, the second base station antenna may include a rearwardly-extending cowling that has a downwardly facing end cap that has a plurality of connectors mounted therein. At least some of these connectors may have respective longitudinal axes that extend in a vertical direction.

In some embodiments, each high-band radiating element may have a mechanical downtilt that is provided by angling a backplane of the third array of high-band radiating elements by at least 1 degree from the vertical direction.

In some embodiments, the low-band radiating elements may be connected to at least one low-band phase shifter, the mid-band radiating elements are connected to at least one mid-band phase shifter, and the high-band radiating elements are connected to at least one high-band phase shifter, and wherein the at least one high-band phase shifter has a first pre-set electronic downtilt that exceeds a second pre-set downtilt of the at least one low-band phase shifter and that exceeds a third pre-set downtilt of the at least one mid-band phase shifter.

Pursuant to further embodiments of the present invention, base station antenna units are provided that include a first base station antenna that includes a first housing having a first bottom end cap and a second base station antenna that includes a second housing having a second bottom end cap. The second base station antenna mounted in a stacked arrangement in a vertical direction immediately above the first base station antenna. The second bottom end cap includes a plurality of connectors mounted therein.

In some embodiments, the first and second base station antennas are configured to be mounted as a single structure.

In some embodiments, at least some of the connectors have respective longitudinal axes that extend in the vertical direction.

In some embodiments, a periphery of a first horizontal cross-section through a central portion of the first base station antenna is substantially the same as a periphery of a second horizontal cross-section through a central portion of the second base station antenna.

In some embodiments, the first base station antenna includes a first vertically-disposed linear array of low-band radiating elements and a second vertically-disposed linear array of mid-band radiating elements and the second base station antenna includes a planar array of high-band radiating elements.

In some embodiments, a lowermost portion of the second base station antenna is located within four inches of an uppermost portion of the first base station antenna.

In some embodiments, a maximum horizontal depth of the first base station antenna is less than a maximum horizontal depth of the second base station antenna.

In some embodiments, the second base station antenna includes a rearwardly extending cowling, and the second bottom end cap is a downwardly facing end cap that is part of the cowling and that has a plurality of connectors mounted therein.

In some embodiments, the first base station antenna and the second base station antenna share a common radome.

Pursuant to still further embodiments of the present invention, base station antennas are provided that include a backplane, a first vertically-disposed linear array of low-band radiating elements mounted in front of the backplane, a second vertically-disposed linear array of mid-band radiating elements mounted in front of the backplane, and a third two-dimensional array of high-band radiating elements mounted in front of the backplane. Uppermost ones of the high-band radiating elements are mounted higher in front of the backplane than is an uppermost one of the low-band radiating elements and an uppermost one of the mid-band radiating elements when the base station antenna is mounted for use.

In some embodiments, the high-band radiating elements are down-tilted from a plane that is parallel to a plane defined by the horizon when the base station antenna is mounted for use.

In some embodiments, the base station antenna may further include a fourth vertically-disposed linear array of mid-band radiating elements mounted in front of the backplane, where the first vertically-disposed linear array of low-band radiating elements is between the second and fourth vertically-disposed linear arrays of mid-band radiating elements.

In some embodiments, an uppermost low-band radiating element is mounted higher on the backplane than is an uppermost mid-band radiating element.

In some embodiments, each low-band radiating element is a cross-polarized radiating element having a vertically-oriented dipole and a horizontally-oriented dipole.

In some embodiments, at least one of the low-band radiating elements is mounted within a periphery of the third two-dimensional array of high-band radiating elements.

DETAILED DESCRIPTION

Many state-of-the-art base station antennas now include multiple vertical columns ("arrays") of radiating elements in order to support several different types of cellular service. A very common base station antenna configuration includes a first vertical linear array of radiating elements that transmits and receives signals in a first frequency band (herein the "low-band") and one or more additional vertical linear arrays of radiating elements that transmit and receive signals in a second frequency band (herein the "mid-band") that is at higher frequencies than the first frequency band. These antennas are referred to as "dual-band" antennas as they support service in two different frequency bands using two different sets of radiating elements. Typically, the first frequency band includes one or more specific frequency bands that are below about 1.0 GHz, and the second frequency band includes one or more specific frequency bands that are in the range of 1.0-3.0 GHz (and typically between about 1.6-2.7 GHz). The specific frequency bands may correspond to specific types of cellular service such as, for example, Global System for Mobile Communications ("GSM") service, Universal Mobile Telecommunications system ("UTMS") service, Long Term Evolution ("LTE") service, CDMA service, etc.

Figure 1A:
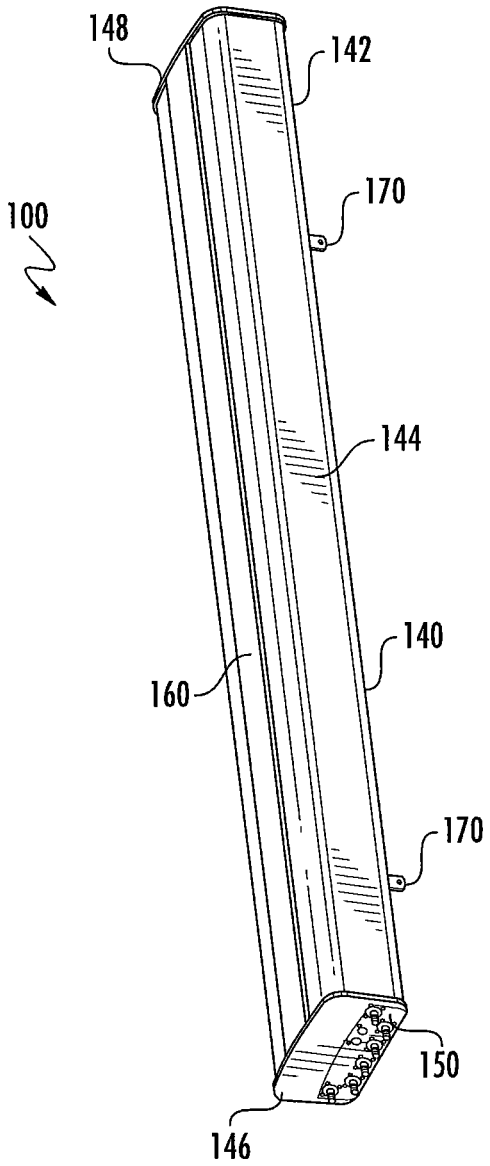
FIG. 1A is a perspective view of a conventional multi-band base station antenna.
Figure 1B:
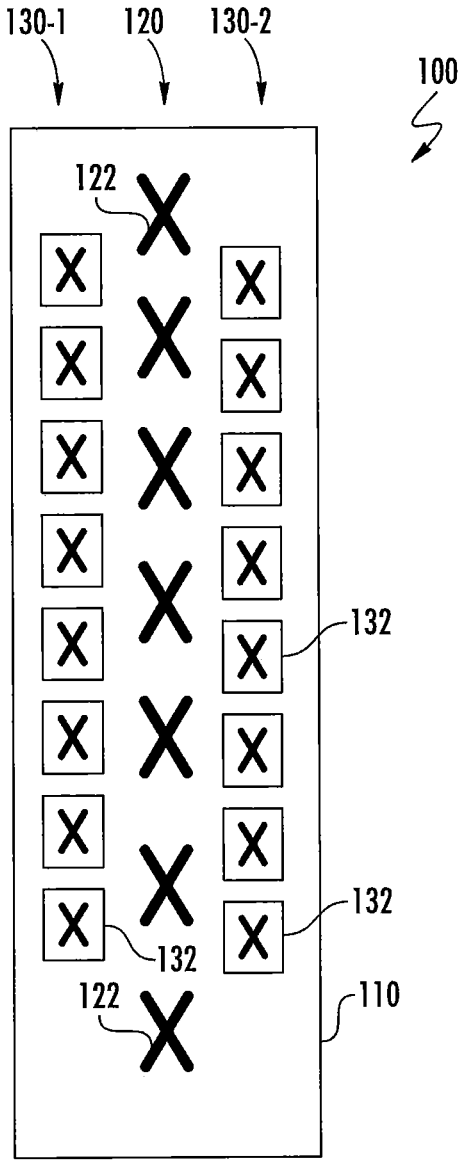
FIG. 1B is a schematic front view of the conventional multi-band base station antenna of FIG. 1A with the radome thereof removed to reveal the linear arrays of radiating elements included in the antenna.

FIGS. 1A and 1B illustrate a typical conventional multi-band base station antenna 100. In particular, FIG. 1A is a perspective view of the conventional multi-band base station antenna 100 and FIG. 1B is a schematic front view of the multi-band base station antenna 100 with the radome removed therefrom to schematically illustrate the linear arrays of radiating elements included in the antenna 100.

As shown in FIG. 1A, the conventional multi-band base station antenna 100 includes a housing 140 and a radome 160 that is mounted on a front portion of the housing 140. The housing 140 may comprise a tray 142 that extends around the sides and back of the antenna 100 and bottom and top end caps 146, 148. The tray 142, end caps 146, 148 and radome 160 protect the antenna 100. The radome 160 and tray 142 may be formed of, for example, extruded plastic, and may be multiple parts or implemented as a monolithic structure. In other embodiments, the tray 142 may be made from metal and may act as an additional reflector to improve the front-to-back ratio for the antenna 100. Mounting brackets 170 may extend through the back of the tray 142 which may be used to mount the base station antenna 100 to another structure such as, for example, an antenna tower (not shown). A plurality of connectors 150 may extend through respective openings in the bottom end cap 146. Cables (not shown) may be connected to the connectors 150 to pass signals between the base station antenna 100 and a plurality of radios (not shown).

Referring now to FIG. 1B, it can be seen that the base station antenna includes a first vertical array 120 of low-band radiating elements 122, a second vertical array 130-1 of mid-band radiating elements 132 and a third vertical array 130-2 of mid-band radiating elements 132. Note that herein when multiple of the same component are provided the components may be assigned two-part reference numerals and the components may be referred to individually by their full reference numeral (e.g., vertical array 130-2) and collectively by the first part of their reference numerals (e.g., the vertical arrays 130). Each of the three vertical arrays 120, 130-1, 130-2 may be mounted on a reflector 110. The radiating elements 122 in the first vertical array 120 may be fed by a first corporate feed network (not shown) that divides a low-band RF signal to be transmitted into a plurality of sub-components. Each sub-component may be fed to one of the radiating elements 122 or to a sub-array that includes multiple of the radiating elements 122. One or more phase shifters (not shown) may be included in the corporate feed network. The phase shifters may apply different phase shifts to respective ones of the sub-components of the low-band RF signal to apply a phase taper to the sub-components that may be used to control the elevation beamwidth of an antenna beam formed by the first vertical array 120 and/or to adjust the elevation angle of the antenna beam formed by the first vertical array 120. The antenna beam formed by the first vertical array 120 may have an azimuth beamwidth of, for example, about 125 degrees and an elevation beamwidth of about 10-30 degrees in example embodiments. The phase shifters and the corporate feed network may be mounted within the housing 140.

In some embodiments, the second and third vertical arrays 130-1, 130-2 may be fed by a second corporate feed network (not shown) that divides a mid-band RF signal to be transmitted into a plurality of sub-components. Each sub-component may be fed to one of the radiating elements 132 or to a sub-array that includes multiple of the radiating elements 132. One or more phase shifters (not shown) may be included in the corporate feed network. The phase shifters may apply different phase shifts to respective ones of the sub-components of the mid-band RF signal to apply a phase taper to the sub-components that may be used to control the elevation beamwidth of an antenna beam formed by the second and third vertical arrays 130-1, 130-2 and/or to adjust the elevation angle of the antenna beam formed by the second and third vertical arrays 130-1, 130-2. The antenna beam formed by the second and third vertical arrays 130-1, 130-2 may have an azimuth beamwidth of, for example, about 125 degrees and an elevation beamwidth of about 10-30 degrees. In other embodiments, the second and third vertical arrays 130-1, 130-2 may be fed by respective second and third corporate feed networks (not shown). For example, the second and third vertical arrays 130-1, 130-2 may be connected to respective radios that communicate in different sub-bands of the second frequency range. In such embodiments, the second and third vertical arrays 130-1, 130-2 may generate independent antenna beams that overlap in coverage area but are separated in frequency.

Many mobile operators are considering deploying new services in a third frequency band that is at higher frequencies than the first and second frequency bands discussed above. For example, a number of mobile operators, particularly in Europe and/or the United States, are considering supporting new services using a frequency band at about 3.5 GHz. Service could also be supported, for example, in the unlicensed 5 GHz spectrum. These frequency bands could be used to support, for example, Long Term Evolution ("LTE") time division duplexing ("TDD") service or other 5G technologies. In order to avoid increasing the antenna count at cellular base stations, it may be desirable to support services in a third frequency band in the same antenna structure used to support services in the first and second frequency bands. Reducing the number of antennas may have a number of advantages including reduced installation costs, a reduction in the number of mounting supports required on the antenna tower, a reduction in the overall weight of the antennas and a more aesthetic appearance, and may also be required in some cases to comply with local ordinances and/or zoning regulations.

Unfortunately, increasing the number of frequency bands supported by a base station antenna may tend to require larger and more complex antenna structures. Moreover, the more frequency bands that are supported by a base station antenna, the more likely it is that interference will arise between signals transmitted in the different frequency bands. For example, it is expected that integrating radiating elements for a 3.5 GHz or 5 GHz frequency band into a conventional dual-band base station antenna such as base station antenna 100 that supports services in the above-described first and second frequency bands will require compromising some of the performance metrics for the lower frequency bands. As such, many operators are considering supporting the 3.5 GHz or 5 GHz frequency band using separate antenna structures, despite the above described disadvantages of using separate units.

Base station antennas typically come in several vertical lengths. In particular, the elevation beamwidth of a vertical array of radiating elements included on a base station antenna is a function of (1) the frequency band and (2) the spacing between the uppermost and lowermost radiating elements in the vertical array. Depending upon the size and geography of the cell and various other parameters, an operator may require base station antennas with different elevation beamwidths. For example, in some cases, it may be desirable to have a small elevation beamwidth (e.g., 10-15 degrees) in order to increase the antenna gain and/or to reduce spillover of the antenna beam into adjacent cells (as such spillover appears as interference in the adjacent cells). This requires relatively long base station antennas that have a large spacing between the uppermost and lowermost radiating elements in order to narrow the elevation beamwidth of the antenna beam. In other cases, larger elevation beamwidths are acceptable, allowing the use of shorter base station antennas that have fewer radiating elements in the vertical arrays. Typical heights for base station antenna are 1.5 meters (or 4 feet), 2.0 meters (or 6 feet) and 2.5 meters (or 8 feet). While the number of base station antennas deployed at a base station is an important parameter (e.g., to comply with local zoning ordinances and/or because installation fees are typically charged on a per antenna basis), less attention is typically paid to the height of each base station antenna.

Pursuant to embodiments of the present invention, composite base station antenna units are provided in which first and second base station antennas are mounted together in a vertically stacked arrangement so that the composite base station antenna unit has the appearance of a single base station antenna. The first base station antenna may comprise a conventional dual-band base station antenna that includes one or more low-band vertical arrays of radiating elements that communicate in a first frequency band (e.g., some or all of the 696-960 MHz band) and one or more mid-band vertical arrays of radiating elements that communicate in a second frequency band (e.g., the 2.5-2.7 GHz band). The height of the first base station antenna (i.e., the length of the antenna in the vertical direction that is perpendicular to the plane defined by the horizon when the antenna is mounted for use) may be, for example, in the range of about 1.0 meters to about 2.0 meters. The second base station antenna may comprise, for example, a planar array of radiating elements that communicate in a third frequency band (e.g., the 3.5 GHz or 5 GHz bands). The height of the second base station antenna may be for example, in the range of about 0.5 meters or less in some embodiments. As a result, the base station antenna units according to embodiments of the present invention may be no longer than conventional 2.5 meter base station antennas.

The first and second base station antennas may be mounted as a single unit and may appear, at least from a distance, as a single base station antenna. For example, the first and second base station antennas may be vertically aligned and may have substantially the same width. In some embodiments, the two antennas may be in direct contact, or nearly so, such that they appear as a single antenna when viewed from the front. The two antennas may be fixed to each other or fixed to a common mounting structure that connects the two antennas to form the single base station antenna unit. The single base station antenna unit including the two base station antennas may be mounted to an antenna tower or other raised structure using conventional base station antenna mounting hardware in some embodiments. By combining the two base station antennas into a single base station antenna unit it will appear as if there are fewer base station antennas mounted on a cell tower, which may be more aesthetically pleasing. The base station antenna units according to embodiments of the present invention may also be cheaper and easier to mount on a cell tower and require less mounting hardware as compared to two separate base station antennas that provide comparable functionality.

In some embodiments, the first base station antenna may include a first vertical array of low-band radiating elements and second and third vertical arrays of mid-band radiating elements. The first vertical array may be positioned between the second and third vertical arrays. The second base station antenna may include a fourth array of high-band radiating elements. The fourth array may include multiple columns of high-band radiating elements which may be arranged in a planar array. In some embodiments, the fourth array may include at least three vertical columns of high-band radiating elements and at least three rows of high-band radiating elements.

In some embodiments, the first and second base station antennas may share a common radome. The use of such a common radome may enhance the appearance that the two base station antennas are a single antenna. In further embodiments, the first and second base station antennas may be replaced with a single base station antenna that includes all four of the above-described first, second, third and fourth arrays of radiating elements. The fourth array may be mounted above the first, second and third vertical arrays. The first vertical array may be mounted between the second and third vertical arrays.

Embodiments of the present invention will now be discussed in further detail with reference to the figures, in which example embodiments of the invention are shown.

Figure 2A:
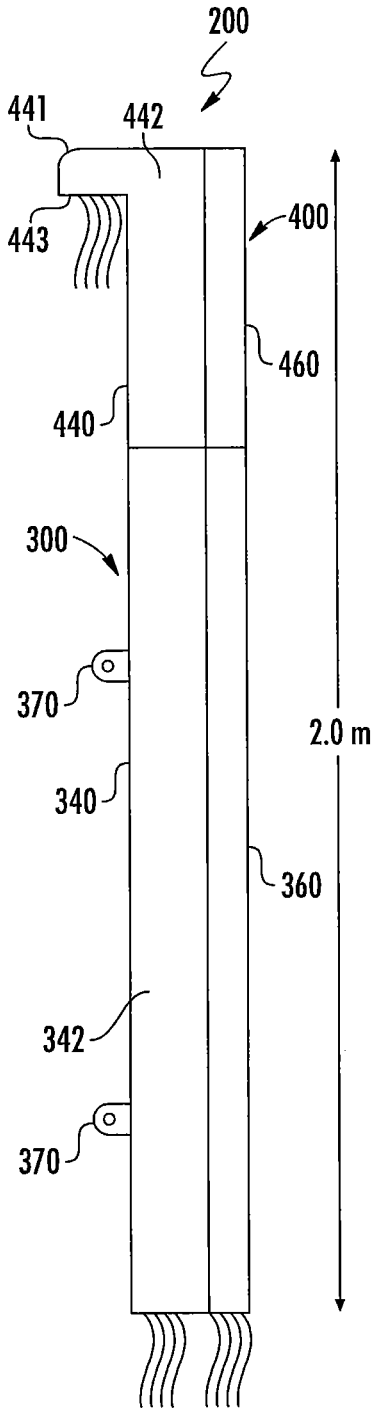
FIG. 2A is a schematic side view of a multi-band base station antenna unit according to certain embodiments of the present invention that includes two co-mounted base station antennas.
Figure 2B:
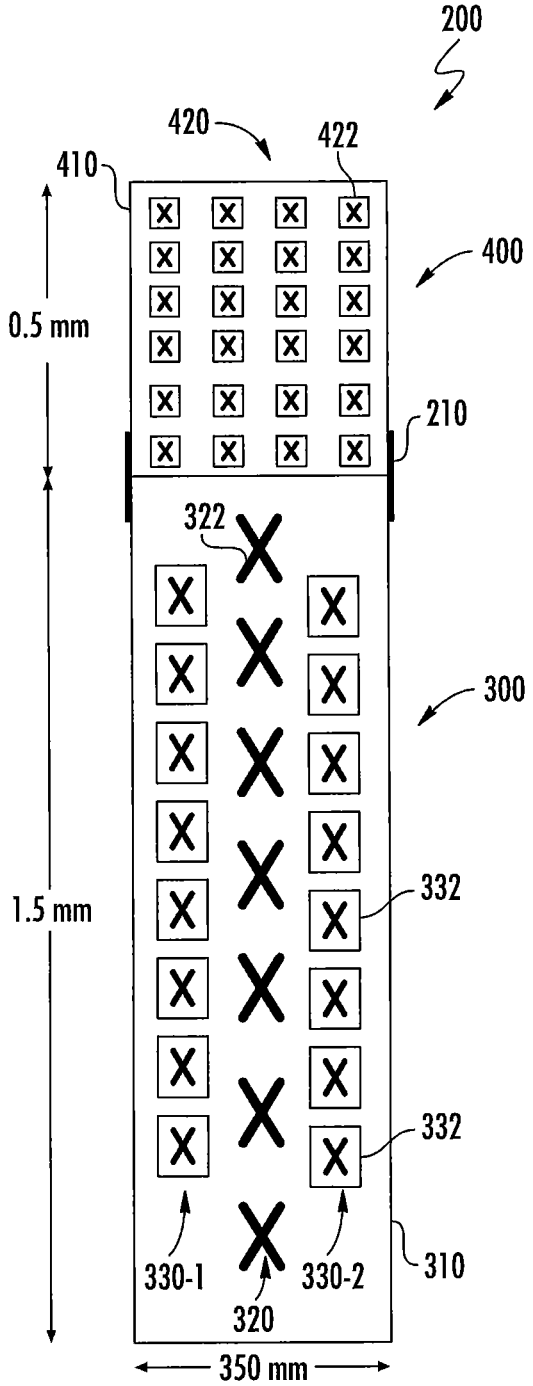
FIG. 2B is a schematic front view of the multi-band base station antenna unit of FIG. 2A with the radomes of each base station antenna removed.
Figure 2C:
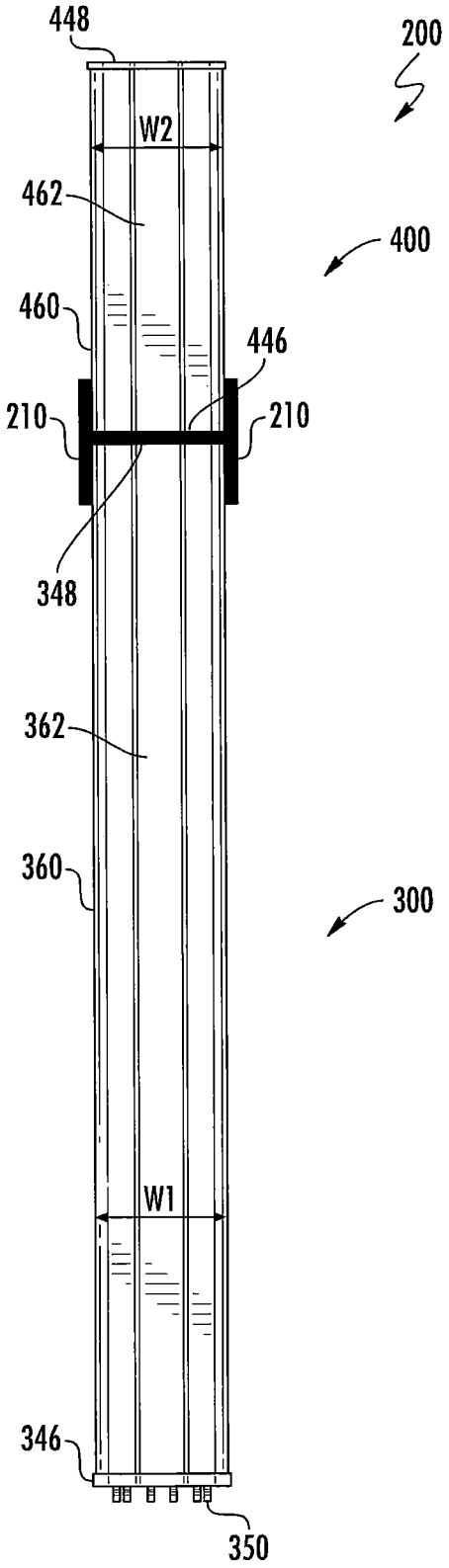
FIG. 2C is a front view of the multi-band base station antenna unit of FIG. 2A with the radomes of each base station antenna in place.
Figure 3A:
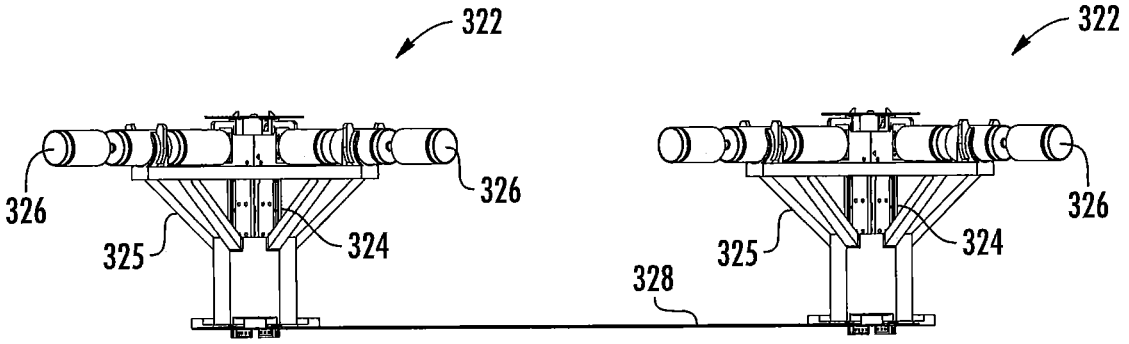
FIGS. 3A and 3B are a side view and a front view, respectively, of two of the low-band radiating elements included in the base station antenna unit of FIGS. 2A-2C.
Figure 3B:
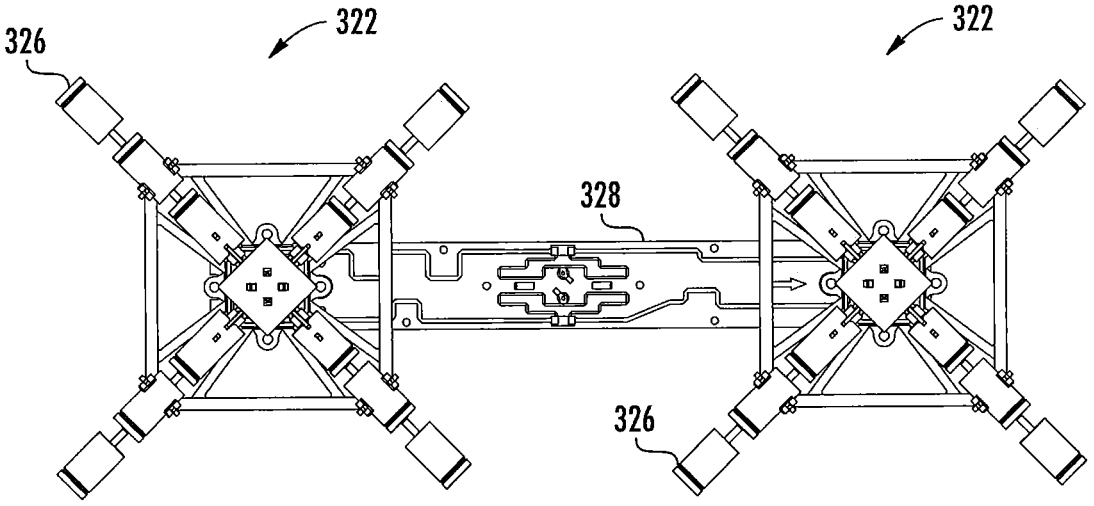
Figure 3C:
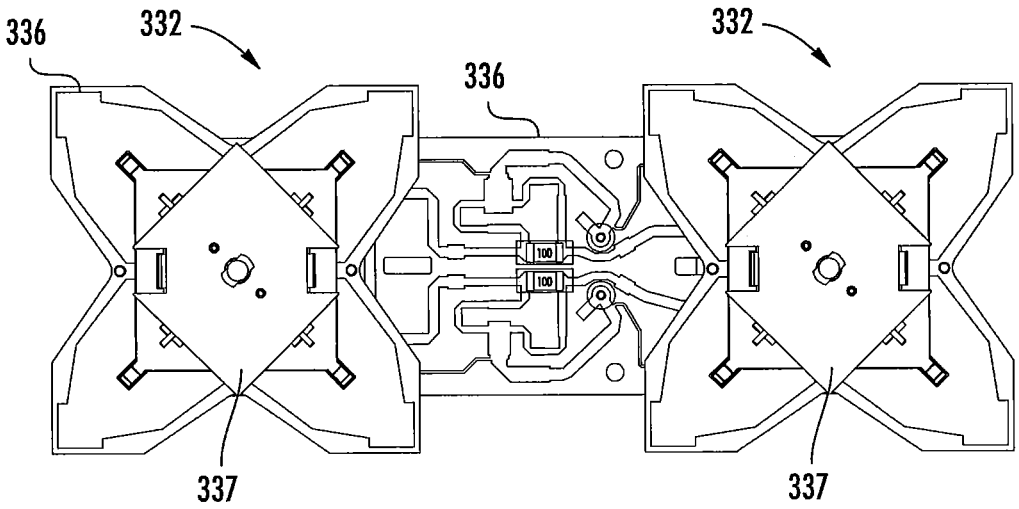
FIGS. 3C and 3D are a front view and a side view, respectively, of two of the mid-band radiating elements included in the base station antenna unit of FIGS. 2A-2C.
Figure 3D:
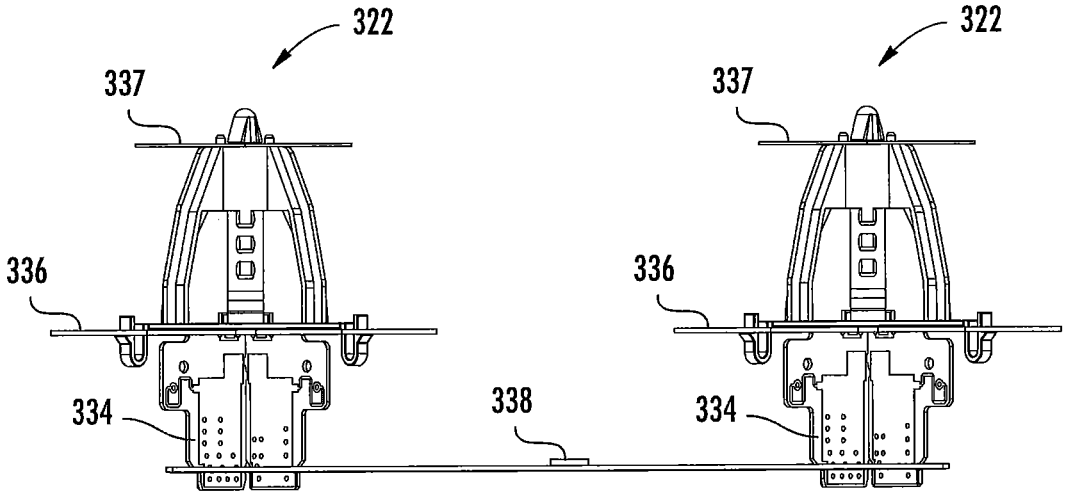

FIGS. 2A-2C and 3A-3D illustrate a base station antenna unit 200 according to certain embodiments of the present invention that includes two co-mounted base station antennas 300, 400. In particular, FIG. 2A is a schematic side view of a multi-band base station antenna unit 200, FIG. 2B is a schematic front view of the multi-band base station antenna unit 200 with the radomes of each base station antenna 300, 400 removed, and FIG. 2C is a front view of the multi-band base station antenna unit 200 with the radomes of each base station antenna 300, 400 in place. FIGS. 3A and 3B are a side view and a front view, respectively, of two of the low-band radiating elements included in the base station antenna 300. FIGS. 3C and 3D are a front view and a side view, respectively, of two of the mid-band radiating elements included in the base station antenna unit 300.

Referring to FIGS. 2A and 2C, the base station antenna unit 200 includes a first base station antenna 300 and a second base station antenna 400. The second base station antenna 400 is mounted on top of the first base station antenna 300. The first and second base station antennas 300, 400 may appear to be a single base station antenna. The second base station antenna 400 may be referred to herein as a "high-band box top" as the second base station antenna 400 may be configured to communicate in a high frequency band and may be mounted atop the first base station antenna 300.

Referring to FIG. 2B, the first base station antenna 300 includes three vertically-oriented linear arrays of radiating elements, namely a low-band array 320 that includes a plurality of low-band radiating elements 322 and first and second mid-band arrays 330-1, 330-2 that each include a plurality of mid-band radiating elements 332. The vertical arrays 320, 330-1, 330-2 may be identical to the vertical arrays 120, 130-1, 130-2 of the base station antenna 100 discussed above. It will be appreciated that any appropriate number of radiating elements 322, 332 may be included in the vertical arrays 320, 330-1, 330-2. The radiating elements 322, 332 are mounted on a backplane 310. The backplane 310 may comprise a unitary structure or may comprise a plurality of structures that are attached together. The backplane 310 may comprise, for example, a reflector that serves as a ground plane for the radiating elements 322, 332.

Referring now to FIGS. 3A and 3B, it can be seen that each low-band radiating element 322 may comprise a stalk 324 and a radiator 326. Each stalk 324 may comprise one or more printed circuit boards. The radiator 326 may comprise, for example, a dipole radiator. In the depicted embodiment, the base station antenna 300 is a dual-polarized antenna, and hence each radiator 326 comprises a cross-dipole structure. Each radiator 326 may be disposed in a plane that is substantially perpendicular to a longitudinal axis of the corresponding stalk 324 of the radiating element 322. In the depicted embodiment, the low-band radiating elements 322 are mounted in pairs on respective feed boards 328 that provide the sub-components of an RF signal that is to be transmitted to the respective radiating elements 322. Supports 325 may facilitate holding the radiators 326 in place. It will be appreciated that while FIGS. 3A-3B illustrate one example low-band radiating element 322 that may be used in the base station antenna units according to embodiments of the present invention, any appropriate low-band radiating elements may be used.

As shown in FIGS. 3C-3D, each mid-band radiating element 332 may comprise a stalk 334 and a radiator 336. Each stalk 334 may comprise one or more printed circuit boards. The radiator 336 may comprise, for example, a dipole or patch radiator. In the depicted embodiment, each mid-band radiator 336 comprises a cross-dipole radiator 336 that is formed on a printed circuit board. Each radiator 336 may be disposed in a plane that is substantially perpendicular to a longitudinal axis of the corresponding stalk 334 of the radiating element 332. In the depicted embodiment, the mid-band radiating elements 332 are mounted in pairs on respective feed boards 338 that provide the sub-components of an RF signal that is to be transmitted to the respective radiating elements 332. Directors 337 may be mounted above the radiating elements 332 to help narrow the beamwidth of the radiating elements 332.

Referring again to FIGS. 2A-2C, the first base station antenna 300 further includes a housing 340 and a radome 360. The housing 340 may comprise a tray 342 that extends around the sides and back of the antenna 300 and bottom and top end caps 346, 348. The tray 342, end caps 346, 348 and radome 360 protect the antenna 300. The radome 360 and tray 342 may be formed of, for example, extruded plastic, and may be multiple parts or implemented as a monolithic structure. In other embodiments, the tray 342 may be made from metal. Mounting brackets 370 may extend through the back of the tray 342.

The backplane 310 may be mounted on or in the housing 340. The radiating elements 322, 332 of the first through third vertical arrays 320, 330-1, 330-2 may extend forwardly from the backplane 310. The radome 360 may be attached to the tray 342 and may extend forwardly therefrom to cover and protect the radiating elements 322, 332.

A plurality of connectors 350 may be mounted within openings in the bottom end cap 346. Each connector 350 may have a longitudinal axis. The longitudinal axes of at least some of the connectors 350 may extend substantially in the vertical direction when the base station antenna 300 is mounted for use.

A plurality of circuit elements and other structures may be mounted within the housing 340. These circuit elements and other structures may include, for example, phase shifters for one or more of the first through third vertical arrays 320, 330-1, 330-2, remote electronic tilt (RET) actuators for mechanically adjusting the phase shifters, one or more controllers, filters such as duplexers and/or diplexers, cabling connections, RF transmission lines and the like.

The second base station antenna 400 includes a two-dimensional planar array 420 of high-band radiating elements 422. The planar array 420 may include at least two columns and two rows of high-band radiating elements 422. In the depicted embodiment, the planar array 420 includes four columns and six rows of high-band radiating elements 422 for a total of twenty-four high-band radiating elements 422. The high-band radiating elements 422 are mounted on a backplane 410. The backplane 410 may comprise a unitary structure or may comprise a plurality of structures that are attached together. The backplane 410 may comprise, for example, a reflector that serves as a ground plane for the high-band radiating elements 422.

In some embodiments, each high-band radiating element 422 may comprise a dipole or patch radiator. If the base station antenna 400 is a dual-polarized antenna, each high-band radiating element 422 may comprise, for example, a cross-dipole structure.

The second base station antenna 400 further includes a housing 440 and a radome 460. The backplane 410 may be mounted on or in the housing 440. The high-band radiating elements 422 of the fourth planar array 420 may extend forwardly from the backplane 410. The radome 460 may be attached to the housing 440 and may extend forwardly therefrom to cover and protect the high-band radiating elements 422.

The housing 440 may comprise a tray 442 that extends around the sides and back of the antenna 400 and bottom and top end caps 446, 448. The radome 460 and tray 442 may be formed of, for example, extruded plastic, and may be formed of multiple parts or implemented as a monolithic structure. In other embodiments, the tray 442 may be made from metal. An upper portion of the housing 440 may extend farther rearwardly than a lower portion of the housing 440 to define a lip 441. A base plate 443 may form a bottom surface of the lip 441. A plurality of connectors 450 may be mounted within openings in the base plate 443. Each connector 450 may have a longitudinal axis. The longitudinal axes of at least some of the connectors 450 may extend substantially in the vertical direction. Since the bottom end cap 446 may not be accessible when the second base station antenna 400 is mounted on the first base station antenna 300, the lip 441 and base plate 443 provide a convenient means for mounting the connectors 450 of the second base station antenna 400 in a readily accessible location.

In some embodiments, the high-band radiating elements 422 may be configured to operate in the 3.5 GHz frequency band or the 5 GHz frequency band, although embodiments of the present invention are not limited thereto. The planar array 420 of high-band radiating elements 422 may be configured to perform time division duplexing beamforming operations in which different antenna beams may be formed in different time slots to provide communications to different users or sets of users during each different time slot. The planar array 420 of high-band radiating elements 422 may be configured to generate multiple different antenna beams during any given time slot in order to provide high directivity coverage to selected portions of a coverage area during a given time slot.

As shown in FIGS. 2A-2C, the second base station antenna 400 is mounted on top of the first base station antenna 300 to form the base station antenna unit 200. A lowermost portion of the second base station antenna 400 may be located, for example, within six inches, or within four inches, or within two inches of an uppermost portion of the first base station antenna 300 in example embodiments. The front surface 462 of the radome 460 of the second base station antenna 400 may be substantially vertically aligned with the front surface 362 of the radome 360 of the first base station antenna 300. As shown in FIG. 2C, the width W1 of the radome 360 may be substantially the same as the width W2 of the second radome 460. The front surfaces 362, 462 of the respective first and second radomes 360, 460 may be curved front surfaces. The front surfaces 362, 462 may have substantially the same curvature in some embodiments.

An attachment mechanism 210 may be provided that attaches the first base station antenna 300 to the second base station antenna 400. In some embodiments, the attachment mechanism 210 may be one or more supports that extend upwardly from the first base station antenna 300 that are attached to, surround and/or otherwise support the second base station antenna 400. In other embodiments, the attachment mechanism 210 may be one or more supports that extend downwardly from the second base station antenna 400 that are attached to the first base station antenna 300. In still other embodiments, the attachment mechanism 210 may comprise a separate structure that is attached to both of the first and second base station antennas 300, 400. A wide variety of other attachment mechanisms 210 will be apparent to those of skill in the art in light of the teachings of the present disclosure, and it will be appreciated that any appropriate attachment mechanism 210 may be used.

The attachment mechanism 210 allows the first and second base station antennas 300, 400 to be mounted as a single structure (namely as the base station antenna unit 200). In some embodiments, the first base station antenna 300 may include mounting brackets 370 or other attachment points/structures that are used to mount the base station antenna unit 200 on, for example, an antenna tower. Thus, both base station antennas 300, 400 may be mounted in a single mounting location, saving room on the antenna tower. Additionally, since both base station antennas 300, 400 may be mounted as a single unit using a single set of mounting brackets 370 or the like, it is possible to mount both base station antennas 300, 400 with approximately the same amount of effort required to mount a single conventional base station antenna.

Another advantage of the high-band box top design of base station antenna unit 200 is that coupling between the radiating elements of different frequency bands in a multi-band base station antenna tends to be more problematic when the radiating elements are close to each other in the azimuth (horizontal) plane as opposed to the elevation (vertical) plane. Here, the first base station antenna 300 may comprise a conventional base station antenna that includes, for example, a vertical array of low-band radiating elements that is disposed between a pair of vertical arrays of mid-band radiating elements. Sufficient isolation may be readily achieved between the low-band radiating elements and the mid-band radiating elements using conventional techniques in a base station antenna having a suitably narrow width (e.g., a width of 350 mm or less). If the columns of high-band radiating elements 422 were interspersed between the low-band and mid-band vertical arrays 320, 330-1, 330-2 it may be very difficult to minimize the impact of the high-band radiating elements 422 on the low-band and/or mid-band radiating elements 322, 332, even if decoupling structures are used. However, by mounting the high-band radiating elements 422 above the low-band and mid-band vertical arrays 320, 330-1, 330-2, it is believed that the amount of coupling between the high-band radiating elements 422 and the low-band and/or mid-band radiating elements 322, 332 may be kept low such that all of the low-band, mid-band and high-band arrays 320, 330, 420 may exhibit good performance.

Typical RVV type base station antenna which include one low-band (R-band) linear array and two mid-band (V-band) linear arrays have a width of 350 mm or less. This width may accommodate a high-band array 420 having at least four columns or high-band radiating elements 422 and possibly as many as six columns or high-band radiating elements 422 in the 3.5 GHz frequency band (i.e., a wavelength of 8.5 cm) assuming a 0.65λ spacing between adjacent high-band radiating elements 422. It will be appreciated that high-band box top antennas may also be provided that are configured to be mounted on top of RRVV base station antenna that include two low-band (R-band) linear array and two mid-band (V-band) linear arrays. High-band box top antennas that are designed to be mounted on top of RRVV base station antenna may include an even larger number of columns in the high-band array.

At least from a distance, the base station antenna unit 200 that includes two separate base station antennas 300, 400 will appear as a single base station antenna. This is possible because the first and second base station antennas 300, 400 may have similar or even identical front profiles and may be mounted in close proximity to each other. In fact, in some embodiments, a bottom of the second base station antenna 400 may directly contact a top of the first base station antenna 300. In some embodiments, the second base station antenna 400 may have the rearwardly-extending lip or "cowling" 441 and hence a maximum depth of the second base station antenna 400 may exceed the maximum depth of the first base station antenna 300. As described above, this may facilitate vertically mounting the connectors 450 for the second base station antenna 400 in the base plate 443 so that the cables feeding the second base station antenna 400 may connect to a lower surface of the antenna 400, which helps protect against water/moisture ingress. However, as the cowling 441 is rearwardly-facing it should not substantially disrupt the appearance that the two base station antennas 300, 400 are a single antenna.

Figure 4A:
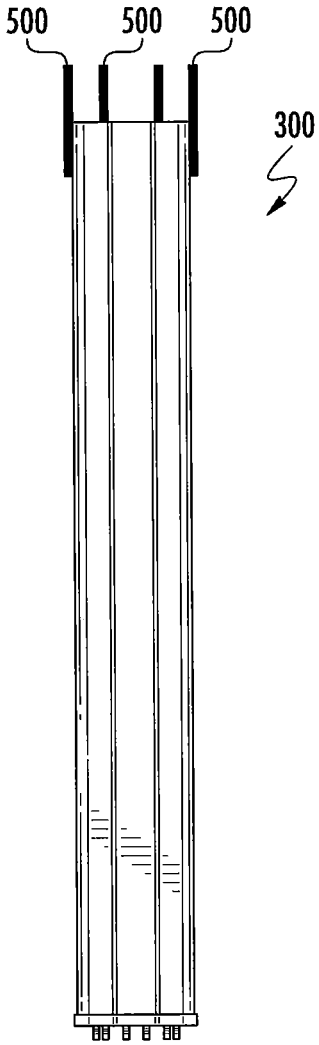
FIGS. 4A-4C are schematic views illustrating several example structural attachments that may be used to connect the two base station antennas of FIGS. 2A-2C to form a base station antenna unit according to embodiments of the present invention.
Figure 4B:
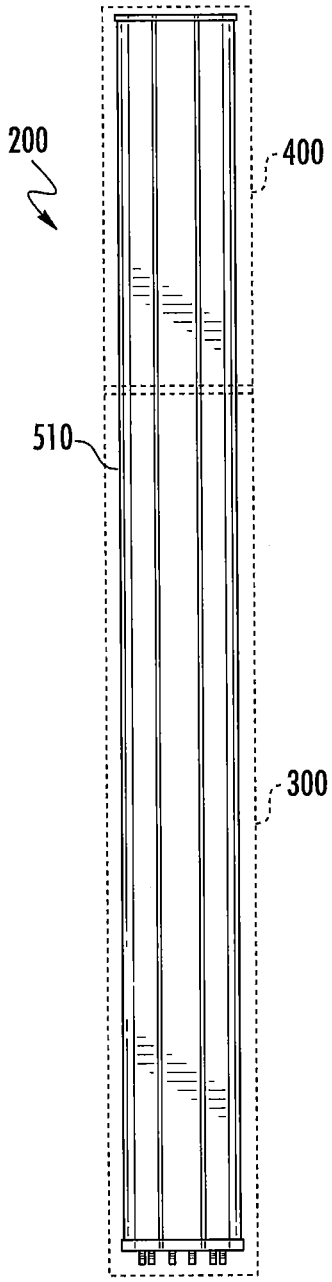
Figure 4C:
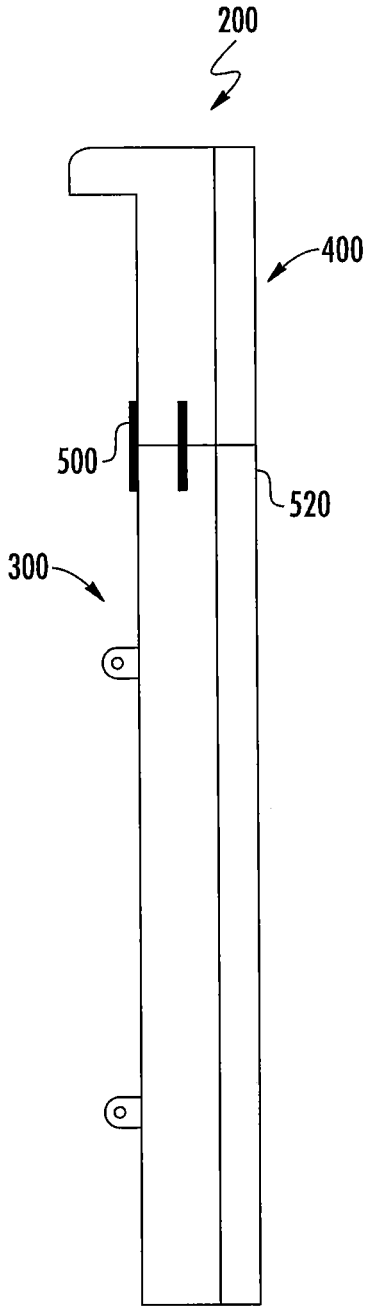

A wide variety of attachment structures may be used to attach the first and second base station antennas 300, 400 to each other to form the base station antenna unit 200. For example, as shown in FIG. 4A, in some embodiments, a plurality of upwardly-extending support arms 500 could be mounted on the upper portion of the housing 340 of the first base station antenna 300 via screws, bolts, rivets or various other attachment mechanisms. The upper portions of these support arms 500 could be attached to the housing 440 of the second base station antenna 400 to attach the two base station antennas 300, 400 together to form the base station antenna unit 200. As shown in FIG. 4B, in another embodiment, an external housing 510 that has a front surface that does not block RF energy may be provided and both the first and second base station antennas 300, 400 could be mounted within this housing 510. The housing 510 may include openings (not visible in the drawing) along the back surface thereof that allow the mounting brackets 370 of the first base station antenna 300 to extend outside of the housing 510 so that the mounting brackets 370 may be used to mount the base station antenna unit 200 on an antenna tower or other structure. As shown in FIG. 4C, in yet other embodiments a composite radome 520 may be provided that acts as the radome for both the first and second base station antennas 300, 400 (eliminating the need for radomes 360, 460), and the composite radome 520 may serve as at least part of the structural mechanism that attaches the first and second base station antennas 300, 400 to each other. In such embodiments, additional structural mechanisms such as the above-described support arms 500 may also be provided.

It will be appreciated that numerous other attachment structures may be used. The attachment structure should provide mechanical integrity and ensure directional stability for the second base station antenna 400 (assuming that mounting brackets 370 on the first base station antenna 300 are used to mount the base station antenna unit 200 to a tower or other structure). The attachment structure also should not have a significant impact on the RF performance of either the first or second base station antennas 300, 400, with the caveat that in some cases an attachment structure may be provided that is designed to improve the RF performance of one or both base station antennas 300, 400 by, for example, attenuating unwanted sidelobes or the like in the antenna patterns thereof.

The base station antenna unit 200 may be field deployable in that the second base station antenna 400 may be designed to be attached to conventional base station antenna in order to form the base station antenna unit 200.

In some embodiments, the high-band array 420 may be designed to have a different coverage area than the low-band and mid-band arrays 320, 330-1, 330-2. For example, in some cases the high-band array 420 may be designed to only cover a portion of the cell that is closer to a mounting structure (e.g., antenna tower) on which the base station antenna unit 200 is mounted. The base station antenna unit 200 may have such a design because the free-space loss at 3.5 GHz or 5 GHz, for example, will be higher than the free-space loss at the frequencies of the low-band and the mid-band, making it potentially more difficult to achieve coverage of the entire cell.

Since the high-band array 420 may have a reduced coverage area, it may be advantageous to "pre-set" the high-band array 420 to have some amount of downtilt (i.e., a tilt at an angle below the horizon in the elevation plane). This downtilt may either be a mechanical downtilt or an electrical downtilt. As known to those of skill in the art, a mechanical downtilt refers to physically pointing the radiating elements of an array downwardly from a plane parallel to the plane defined by the horizon. Such a downtilt is often used so that the main lobe of an antenna beam formed by an array will be pointed at the ground at some distance from the base station antenna. This technique may be used to increase the antenna gain within a coverage area for the base station antenna and/or to reduce the extent to which the antenna beam extends into adjacent cells.

An electrical downtilt refers to a downtilt that is implemented by adjusting the phases and/or amplitudes of the sub-components of an RF signal that is transmitted or received by the radiating elements of an array. Electrically downtilting a phased array antenna is often preferable to using a mechanical downtilt, both because the antenna pattern achieved using electrical downtilt is different from, and often preferable to, the antenna pattern formed by a mechanically downtilted phased array antenna, and because the electrical downtilt is typically implemented from a remote location using "remote electrical downtilt" capabilities by sending control signals that adjust settings on phase shifters included along the RF path in the antenna in order to implement the electronic downtilt.

In some embodiments, each high-band radiating element 422 may have a mechanical downtilt such as, for example, a mechanical downtilt of 1-5 degrees. Since the total height of the second base station antenna 400 may be fairly small (e.g., 0.5 meters or less), it may be possible to achieve this mechanical downtilt by physically tilting the backplane 410 away from the vertical plane within the radome 460. In taller antennas (e.g., 1.5 to 2.5 meter antennas) this may not be possible because the mechanical downtilt may necessitate an increased depth for the antenna. Additionally, the high-band radiating elements 422 may be significantly shorter than the low-band and mid-band radiating elements 322, 332, and hence there may be room for tilting the backplane 410 in the second base station antenna 400.

Pursuant to embodiments of the present invention, the base station antenna units and base station antennas described herein may be designed so that phase shifters that are included in the antenna are pre-set to apply a predetermined amount of electrical downtilt to the high-band array. For example, the phase shifters may be set so that the high-band array has a pre-set downtilt of between two and six degrees in some embodiments. As is known to those of skill in the art, when an electronic downtilt is applied to a phased array antenna, some distortion may occur to the antenna pattern thereof, and the amount of distortion tends to increase with the amount of the downtilt. For example, grating lobes may appear when an electrical downtilt exceeds a certain amount. A pre-set downtilt means that the phase shifters are set so that the highest elevation angle that the high-band array 420 may be set to is below the horizon (e.g., two to six degrees). The amount of downtilt can then be increased some additional amount using the phase shifters included in the corporate feed network for the high-band array 420. In other embodiments, the radiating elements 422 of the high-band array 420 may have a pre-set amount of mechanical downtilt (e.g., 2-6 degrees) and electrical downtilt may then be used to further adjust the elevation pointing angle of the high-band array 420.

In some embodiments, the high-band array 420 may be configured to have a greater amount of pre-set electrical downtilt than does the low-band array 320 and/or mid-band arrays 330.

Figure 5:
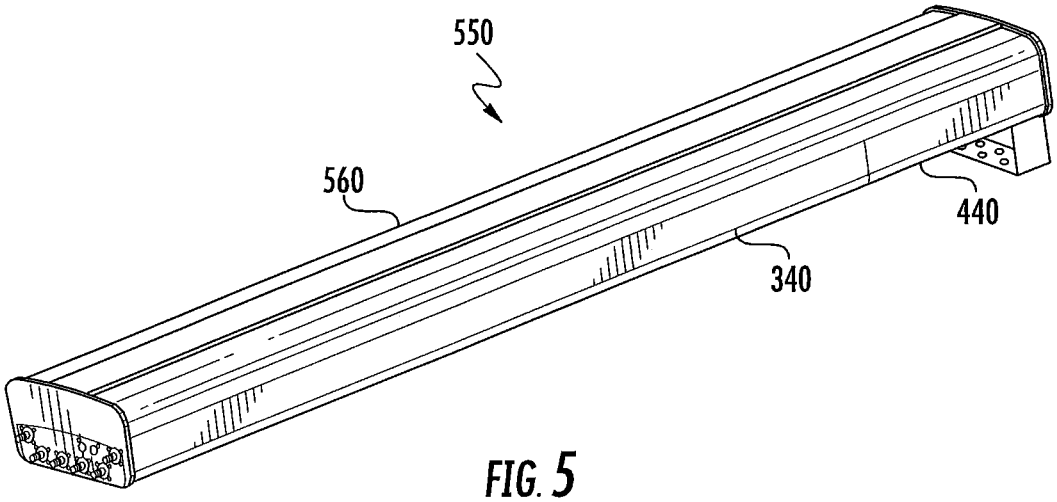
FIG. 5 is a perspective view of a base station antenna unit according to embodiments of the present invention that includes first and second base station antennas that share a common radome.

While the base station antenna unit 200 includes two completely separate base station antennas 300, 400 that are mounted together as a single antenna, it will be appreciated that in other embodiments some components may be shared across both antennas. For example, FIG. 5 is a perspective view of a base station antenna unit 550 that includes first and second base station antennas that share a common radome 560. The use of the common radome may enhance the appearance that the first and second base station antenna are a single antenna.

While the above-described embodiments of the present invention are directed to base station antenna units that include first and second base station antenna, it will be appreciated in light of the teachings of the present disclosure that in other embodiments a single tri-band base station antenna may be provided that includes arrays of radiating elements that support all three of the low-band, mid-band and high-band frequency bands in a single housing. Such base station antennas can have the arrays arranged in the same manner as the base station antenna unit 200 that is described above, although it may also be possible to further optimize the locations of the arrays to reduce interference.

Figure 6A:
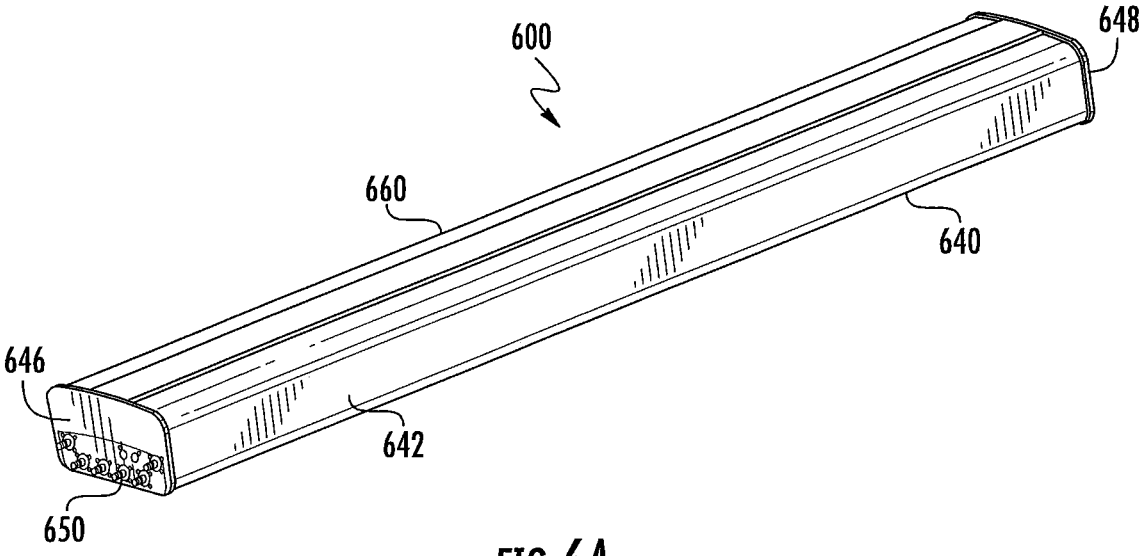
FIGS. 6A-6B are a schematic perspective view and front view, respectively, of a tri-band base station antenna according to further embodiments of the present invention that includes multiple linear arrays of radiating elements along with a planar array of radiating elements.
Figure 6B:
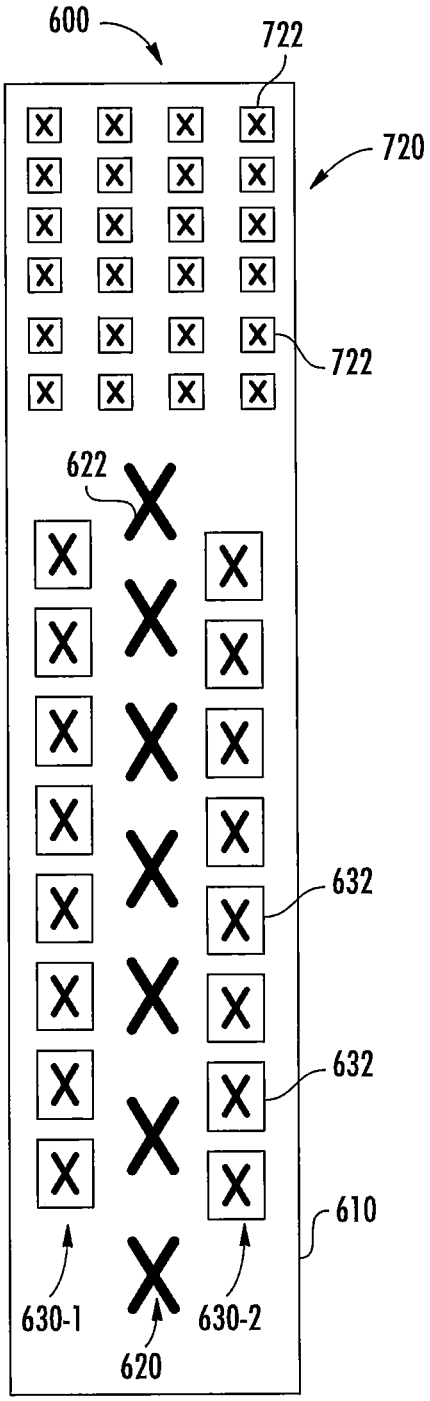
Figure 6C:
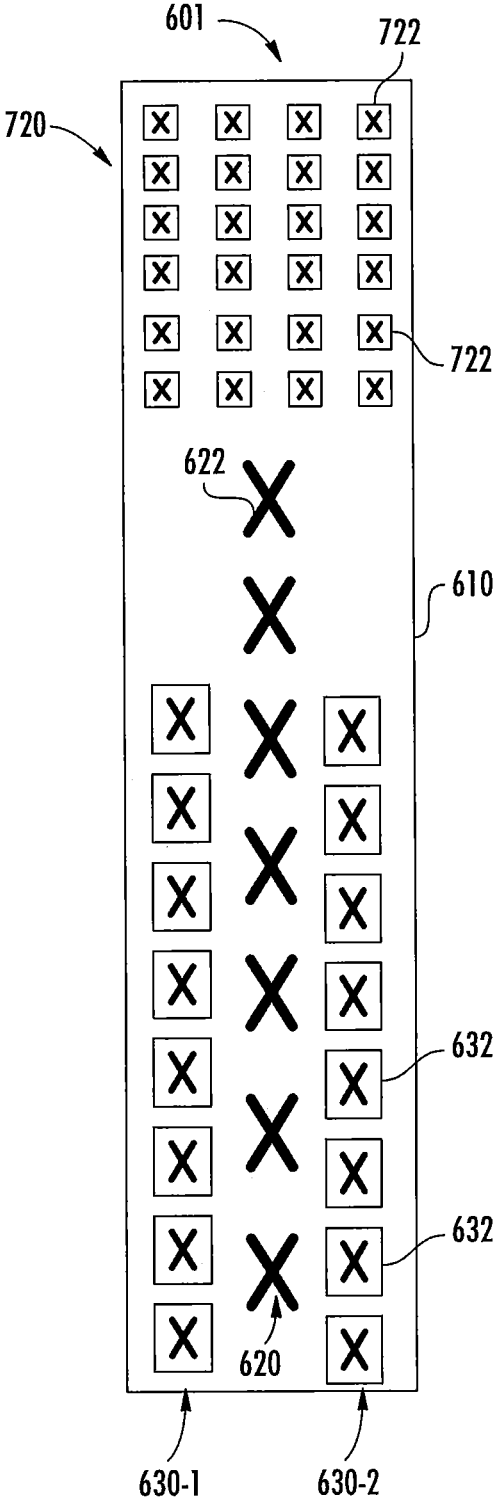
FIGS. 6C-6D are schematic front views of two additional tri-band base station antennas according to further embodiments of the present invention that are modified versions of the tri-band base station antenna of FIGS. 6A-6B.
Figure 6D:
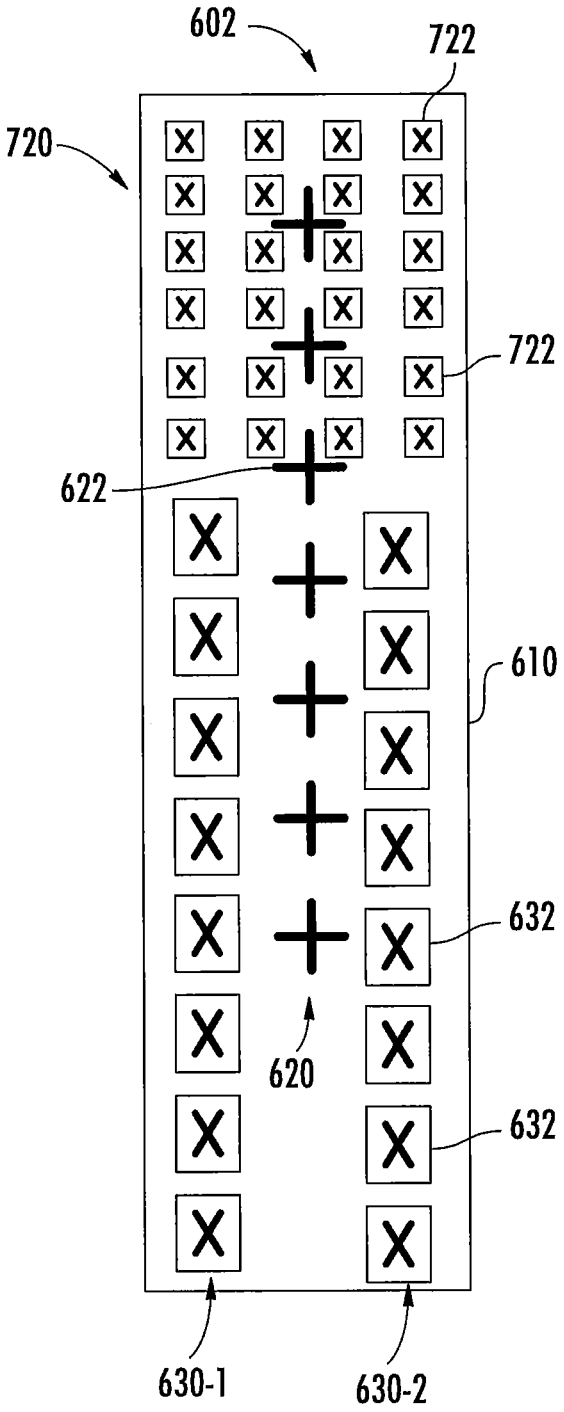

FIGS. 6A-6D schematically illustrate several example tri-band base station antenna 600, 601, 602 according to embodiments of the present invention that have such a design. In particular, FIG. 6A is a schematic perspective view of the tri-band base station antenna 600, and FIG. 6B is a schematic front view of the base station antenna 600 with the radome thereof removed. FIGS. 6C-6D are schematic front views of tri-band base station antennas 601, 602 (with the radomes removed) that are modified versions of the tri-band base station antenna 600.

As can be seen in FIGS. 6A-6B, the tri-band base station antenna 600 includes three vertically-oriented linear arrays of radiating elements, namely a low-band array 620 that includes a plurality of low-band radiating elements 622 and first and second mid-band arrays 630-1, 630-2 that each include a plurality of mid-band radiating elements 632. The low-band radiating elements 622 and the mid-band radiating elements 632 may be identical to the respective low-band radiating elements 322 and the mid-band radiating elements 332 that are described above, and hence further description thereof will be omitted.

The tri-band base station antenna 600 further includes a two-dimensional planar array 720 of high-band radiating elements 722. The planar array 720 may include at least two columns and two rows of high-band radiating elements 722, and may be identical to the planar array 420 that is described above. The high-band radiating elements 722 may be identical to the high-band radiating elements 422 that are described above, and hence further description thereof will be omitted.

The radiating elements 622, 632, 722 may be mounted on a common backplane 610. The backplane 610 may comprise a unitary structure or may comprise a plurality of structures that are attached together. The backplane 610 may comprise, for example, a reflector that serves as a ground plane for the radiating elements 622, 632, 722. As shown in FIG. 6A, the tri-band base station antenna 600 may further include a housing 640 and a radome 660. The backplane 610 may be mounted on or in the housing 640. The radiating elements 622, 632, 722 may extend forwardly from the backplane 610. The radome 660 may be attached to the housing 640 and may extend forwardly therefrom to cover and protect the radiating elements 622, 632, 722. The housing 640 may include a tray 642, a bottom end cap 646 and a top end cap 648. The radome 660 may attach to the tray 642. A plurality of connectors 650 may be mounted within openings in the bottom end cap 646. Notably, the cowling 441 that is included in the second base station antenna 400 discussed above is unnecessary in the antennas 600, 601, 602 since the connectors 750 for the high-band array 720 may be mounted in the bottom end cap 646 and cables or transmission lines may be run through the housing 640 to the corporate feed network for the high-band array 720. The base station antennas 601 and 602 may have the same housing and radome design as base station antenna 600 and hence may appear identical in perspective view to the base station antenna 600 illustrated in FIG. 6A.

The base station antennas 600, 601, 602 differ from each other in the relative locations of the radiating elements 622, 632, 722. For example, as shown in FIG. 6B, the base station antenna 600 is designed to locate the radiating elements 622, 632, 722 in the same positions in which the corresponding radiating elements 322, 332, 422 of base station antenna unit 200 are mounted. Thus, the primary difference between base station antenna unit 200 and base station antenna 600 is that base station antenna 600 includes a single housing 640 and a single radome 660, whereas base station antenna unit 200 includes two housings 340, 440 and two radomes 460, 660. As is also shown in FIG. 6B, since the base station antenna 600 integrates the arrays for all three of the low, mid and high frequency bands into a single antenna, the connectors that are used to transmit RF signals in each of the low, mid and high frequency bands may all be integrated into the bottom end cap 646 of the housing 640, eliminating any need for the cowling 441 that is provided in the base station antenna unit 200 that is described above. The same is true with respect to base station antennas 601 and 602, as can be seen from FIGS. 6C and 6D. The support arms 500 (or other attachment structures) included in base station antenna unit 200 may also be omitted in base station antenna 600.

Turning next to FIG. 6C, it can be seen that the base station antenna 601 is similar to the base station antenna 600, except that the mid-band linear arrays 630-1, 630-2 are moved downwardly on the backplane 610. Typically, a height in the vertical direction of the mid-band linear arrays 630-1, 630-2 is less than a height in the vertical direction of the low-band linear array 620. Moreover, in some cases, the radiating elements 632 of the mid-band linear arrays 630-1, 630-2 may be more prone to interact with the radiating elements 722 of the high-band array 720. Consequently, by mounting the linear arrays 630-1, 630-2 farther downwardly on the backplane 610 the isolation between the mid-band and high-band radiating elements 632, 722 may be improved.

As shown in FIG. 6D, in some cases, the low-band radiating elements 622 and the high-band radiating elements 722 may tend to have very limited coupling therebetween. In such cases, it may be possibly to locate one or more of the low-band radiating elements 622 in openings within the high-band array 720. The base station antenna 602 of FIG. 6D uses cross-polarized low-band radiating elements 622 that have horizontal and vertical polarizations as opposed to slant +45°/−45° polarizations, which is why "+" signs are used to represent the low-band radiating elements 622 in FIG. 6D instead of the "X" that is used to represent slant +45°/−45° cross-polarized low-band radiating elements in other of the figures. The design of base station antenna 602 where one or more of the low-band radiating elements 622 are interleaved between the high-band radiating elements 722 may reduce the overall length of the antenna, which may be advantageous in terms of aesthetics and cost. Such a design may also make it possible to include the array 720 of high-band radiating elements 722 in an antenna that includes a relatively large number of low-band and mid-band radiating elements 622, 632.

It will be appreciated that the embodiments of the invention described above are merely examples. For example, while antennas having specific numbers of arrays and radiating elements are shown in the figures, more or fewer of each type of array and more or fewer radiating elements may be included in other embodiments. Thus, it will be appreciated that the techniques disclosed herein may be used on a wide range of different base station antenna. As another example, the radomes for the base station antenna described above are mounted on the front portion of the antenna. In other embodiments, the radomes may extend all of the way around the antenna. Many other variations are possible.

It will be appreciated that the low-band radiating elements may be "wide-band" radiating elements that support multiple different types of cellular service that are within the low-band frequency range. Likewise, the mid-band radiating elements may be "wide-band" radiating elements that support multiple different types of cellular service that are within the mid-band frequency range. Thus, the multi-band antennas according to embodiments of the present invention may support multiple different types of cellular service within one or more of the frequency bands by using such wide-band radiating elements and using diplexers to split the signals in the two different cellular services that are received by the wide-band radiating elements and to combine the signals in the two different cellular services that are fed to the wide-band radiating elements.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A base station antenna unit, comprising:

a first base station antenna that includes:

a first housing;

a first radome having a front surface that is positioned in front of the first housing;

a first vertically-disposed linear array of low-band radiating elements mounted behind the front surface of the first radome;

a second vertically-disposed linear array of mid-band radiating elements mounted behind the front surface of the first radome;

a second base station antenna that includes:

a second housing that is separate from the first housing;

a second radome having a front surface that is positioned in front of the second housing;

a third array of high-band radiating elements mounted behind the front surface of the second radome, the second radome being separate from the first radome, wherein the first and second base station antennas are mounted in a vertically stacked arrangement, wherein a horizontal width of the first radome is substantially the same as a horizontal width of the second radome, and wherein a lowermost portion of the second base station antenna is located within four inches of an uppermost portion of the first base station antenna.

2. The base station antenna unit of claim 1, wherein the second base station antenna is stacked above the first base station antenna.

3. The base station antenna unit of claim 1, wherein the third array of high-band radiating elements comprises a planar array of radiating elements.

4. The base station antenna unit of claim 3, wherein the planar array includes at least four vertical columns of high-band radiating elements.

5. The base station antenna unit of claim 1, wherein a periphery of a first horizontal cross-section through a central portion of the first base station antenna is substantially the same as a periphery of a second horizontal cross-section through a central portion of the second base station antenna.

6. The base station antenna unit of claim 1, wherein an uppermost low-band radiating element is mounted higher on the backplane than is an uppermost mid-band radiating element.

7. The base station antenna unit of claim 1, wherein a height along the vertical direction of the second base station antenna is less than 0.6 meters.

8. The base station antenna unit of claim 1, wherein a maximum horizontal depth of the first base station antenna is less than a maximum horizontal depth of the second base station antenna.

9. The base station antenna unit of claim 1, wherein each high-band radiating element has a mechanical downtilt that is provided by angling a backplane of the third array of high-band radiating elements by at least 1 degree from the vertical direction.

10. The base station antenna unit of claim 1, wherein the low-band radiating elements are connected to at least one low-band phase shifter, the mid-band radiating elements are connected to at least one mid-band phase shifter, and the high-band radiating elements are connected to at least one high-band phase shifter, and wherein the at least one high-band phase shifter has a first pre-set electronic downtilt that exceeds any second pre-set downtilt of the at least one low-band phase shifter and that exceeds any third pre-set downtilt of the at least one mid-band phase shifter.

11. The base station antenna unit of claim 1, wherein a lowermost portion of the second base station antenna is located within two inches of an uppermost portion of the first base station antenna.

12. The base station antenna unit of claim 1, wherein a lowermost portion of the second base station antenna is located within two inches of an uppermost portion of the first base station antenna.

13. A base station antenna unit, comprising:

a first base station antenna that includes:

a first housing;

a first radome having a front surface that is positioned in front of the first housing;

a first vertically-disposed linear array of low-band radiating elements mounted behind the front surface of the first radome;

a second vertically-disposed linear array of mid-band radiating elements mounted behind the front surface of the first radome;

a second base station antenna that includes:

a second housing that is separate from the first housing;

a second radome having a front surface that is positioned in front of the second housing;

a third planar array of high-band radiating elements mounted behind the front surface of the second radome, the third planar array including at least four vertical columns of high-band radiating elements, and the second radome being separate from the first radome, wherein the first and second base station antennas are mounted in a vertically stacked arrangement, wherein a horizontal width of the first radome is substantially the same as a horizontal width of the second radome, and wherein the front surfaces of the first and second radomes are substantially vertically aligned.

14. The base station antenna unit of claim 13, wherein a lowermost portion of the second base station antenna is located within two inches of an uppermost portion of the first base station antenna.

15. The base station antenna unit of claim 13, wherein a bottom of the second base station antenna directly contacts a top of the first base station antenna.

16. The base station antenna unit of claim 13, wherein an uppermost low-band radiating element is mounted higher on the backplane than is an uppermost mid-band radiating element.

17. The base station antenna unit of claim 13, wherein a height along the vertical direction of the second base station antenna is less than 0.6 meters.

18. The base station antenna unit of claim 13, wherein the high-band radiating elements are connected to at least one high-band phase shifter that includes a pre-set electronic downtilt of at least two degrees.

19. A base station antenna unit, comprising:

a first base station antenna that includes:

a first housing;

a first radome having a front surface that is positioned in front of the first housing;

a first vertically-disposed linear array of low-band radiating elements mounted behind the front surface of the first radome;

a second vertically-disposed linear array of mid-band radiating elements mounted behind the front surface of the first radome;

a second base station antenna that includes:

a second housing that is separate from the first housing;

a second radome having a front surface that is positioned in front of the second housing;

a third array of high-band radiating elements mounted behind the front surface of the second radome, wherein the first and second base station antennas are mounted in a vertically stacked arrangement with the second base station antenna is mounted on top of the first base station antenna, and wherein the high-band radiating elements are connected to at least one high-band phase shifter that includes a pre-set electronic downtilt of at least two degrees.

20. The base station antenna unit of claim 19, wherein a horizontal width of the first radome is substantially the same as a horizontal width of the second radome and the front surfaces of the first and second radomes are substantially vertically aligned.

* * * * *